United States Patent [19]

Ohe et al.

[11] Patent Number: 4,707,701

[45] Date of Patent: Nov. 17, 1987

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 791,525

[22] Filed: Oct. 25, 1985

[30] Foreign Application Priority Data

Oct. 26, 1984 [JP] Japan ..... 59-226397

[51] Int. Cl.[4] ..... H01Q 1/32

[52] U.S. Cl. ..... 343/712

[58] Field of Search ..... 343/711, 712, 713, 743

[56] References Cited

U.S. PATENT DOCUMENTS

| | | | |
|---|---|---|---|
| 2,200,674 | 5/1940 | McDonald, Jr. | 343/700 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 174/110 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/712 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkens et al. | 343/712 |
| 3,728,732 | 4/1973 | Igarashi | 343/712 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 333/32 |
| 3,961,330 | 6/1976 | Davis | 343/712 |
| 3,972,048 | 7/1976 | Davis | 343/712 |
| 4,003,056 | 6/1977 | Davis | 343/713 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |

FOREIGN PATENT DOCUMENTS

| | | | |
|---|---|---|---|
| 889618 | 7/1949 | Fed. Rep. of Germany . | |
| 1131762 | 8/1958 | Fed. Rep. of Germany . | |
| 1949828 | 10/1969 | Fed. Rep. of Germany . | |
| 7015306 | 4/1970 | Fed. Rep. of Germany . | |
| 2425189 | 5/1974 | Fed. Rep. of Germany . | |
| 2733478 | 7/1977 | Fed. Rep. of Germany . | |
| 2745475 | 10/1977 | Fed. Rep. of Germany . | |
| 53-22418 | 8/1978 | Japan . | |
| 53-34826 | 8/1978 | Japan . | |
| 46617 | 4/1980 | Japan | 343/712 |
| 60-175221 | of 1985 | Japan . | |

OTHER PUBLICATIONS

Japanese Pat. Abstract, vol. 6, No. 37 E-97, Mar. 6, 1982, 56-156031.

Japanese Pat. Abstract, vol. 7, No. 162 E-187, 7/15/83, 58-70640, and 58-70642.

Japanese Pat. Abstract, vol. 6, No. 55 E-101, 4/10/82, 56-168441.

*Primary Examiner*—William L. Sikes

*Assistant Examiner*—Robert E. Wise

*Attorney, Agent, or Firm*—Cushman, Darby & Cushman

[57] ABSTRACT

An automobile antenna system for detecting currents induced in a vehicle body by broadcast waves and transmitting the detected current signals to a receiver located in the vehicle body is provided without externally projected antenna poles. The system comprises high-frequency pickup means longitudinally disposed along and in close proximity with the marginal edge portion of the vehicle body, the pickup means being effective to detect surface high-frequency currents which are induced on the vehicle body and concentrated into the marginal edge of the vehicle body, for example, a vehicle roof panel, a rearwindow frame or a vehicle fender. The pickup means is spaced away from the marginal edge of the vehicle body within a range represented by the following formula: $12\times10^{-3}c/f(m)$ where c=the velocity of light and f=the carrier frequency of broadcast waves.

7 Claims, 18 Drawing Figures

AUTOMOBILE ANTENNA SYSTEM

BACKGROUND OF THE INVENTION

1. Field of the Invention

The present invention relates to an improved automobile antenna system for effectively detecting broadcast radio waves received by the vehicle body and then transferring detected signals to various receivers located in the vehicle.

2. Description of the Prior Art

Antenna systems are indispensable to modern automobiles which must positively receive various broadcast waves, such as for radio, television and telephone at receivers located in the vehicle compartment. Such antenna systems are very important also for citizen band tranceivers.

One of the conventional antenna systems is known as a pole-type antenna which projects outwardly from the vehicle body of an automobile. Although a pole antenna is superior in performance in its own way, it becomes an obstacle in vehicle body styling.

Furthermore, the pole antenna is disadvantageous in that it is subject to damage, vandalism or theft and also in that the antenna becomes a cause of producing noises during high-speed driving.

In recent years, there has been increased the number of frequency bands for broadcast or communication waves received at automobiles. A plurality of antennas are required according to the increased number of frequency bands. This raises other problems in that the plurality of pole antennas may degrade the aesthetic appearance of the automobile and also that the reception performance may be highly deteriorated by electrical interference between the antennas.

Efforts have been made to eliminate the pole antenna system or to conceal the same behind the vehicle body. One of the proposals is that a length of antenna wire is applied to the rearwindow glass of an automobile.

Another proposal is that one utilizes surface currents induced by broadcast waves on the vehicle body of an automobile. This apparently provides the most positive and efficient means for receiving broadcast waves. However, experiments show that such a proposal does not provide any satisfactory results.

One of the reasons why surface currents induced by broadcast waves have not been utilized well is that their induced value is not as large as expected. The prior art mainly used surface currents induced in the roof panel of the vehicle body. In spite of this, surface currents of satisfactory level have not been obtained.

Another reason is that surface currents contain noises of very high level. Such noises are mainly generated from the engine ignition system and the battery charging regulator and cannot be eliminated unless the engine is stopped.

In such a situation, some proposals have been made to overcome the above problems. One such proposal is disclosed in Japanese Patent Publication Sho 53-22418 in which electrical insulation is formed at a portion of the vehicle body on which currents are concentrated, with the currents being detected directly by a sensor between the opposite ends of the insulation. Although such a construction can detect practicable signals which are superior in S/N ratio, a pickup used therein requires a particular cutout in the vehicle body. This cannot be accepted in the mass-production of automobiles.

Another proposal is shown by Japanese Utility Model Publication Sho 53-34826 in which an antenna including a pickup coil for detecting currents in the pillar of a vehicle body is provided. This is advantageous in that the antenna can completely be disposed behind the vehicle body. However, it is not practical that the pickup coil used therein must be located adjacent to the vehicle pillar in a direction perpendicular to the longitudinal axis of the pillar. It also appears that such pickup arrangement cannot obtain any practicable output of the antenna.

SUMMARY OF THE INVENTION

It is therefore an object of the present invention to provide an improved antenna system for small-sized automobiles, which can more efficiently detect currents induced in the vehicle body by broadcast waves and then transmit the detected current signals to a receiver located in the vehicle body.

In order to attain the above object, the present invention is characterized by a high-frequency pickup disposed adjacent to the marginal edge of the vehicle body for detecting surface high-frequency currents having a predetermined frequency or more.

The prior art antenna systems mainly intend to receive AM band waves the wavelength of which are too long to obtain good performances by detecting surface currents induced on the vehicle body. The inventors aimed at this dependency of frequency and made it possible to very efficiently attain the reception of signals from surface current induced in the vehicle body by broadcast waves which are above the FM frequency band (normally, above 50 MHz).

The inventors also aimed at the fact that such surface high-frequency currents are produced at various different locations of the vehicle body in various different densities. Our invention is therefore characterized by the high-frequency pickup being disposed at such a location on the vehicle body that has the minimum level of noise and the maximum density of currents induced by broadcast waves. In one preferred form of the present invention, a location capable of satisfying such a condition is particularly at or near the marginal edge of the vehicle body.

Furthermore, the present invention is characterized by the fact that the high-frequency pickup is disposed along the marginal edge of the vehicle body within a range represented by $12\times10^{-3}c/f(m)$ to positively detect the surface high-frequency currents. Where c=the velocity of light and f=the carrier frequency of the wave. The pickup for effecting the detection with an increased efficiency may be in the form of a loop antenna for electromagnetically detecting a magnetic flux induced by surface currents on the vehicle body, of electrode means capable of forming an electrostatic capacity between the pickup and a trunk hinge of the vehicle body to electrostatically detect high-frequency signals or of coil means including a sliding core.

DETAILED DESCRIPTION OF PREFERRED EMBODIMENTS

FIGS. 10 through 18 illustrate a process of determining the distribution of high-frequency currents to know a location at which an antenna system can operate most efficiently on the vehicle body of an automobile.

Figure 10:
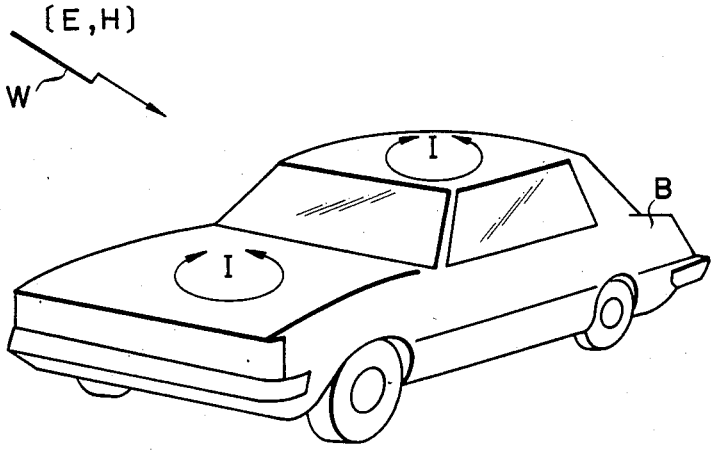
FIG. 10 illustrates surface currents I induced on the vehicle body B by external waves W.

FIG. 10 shows that as external electromagnetic waves W, such as broadcast waves, pass through the vehicle body B of conductive metal, surface currents I are induced at various vehicle locations at levels corresponding to the intensities of electromagnetic waves passing therethrough. The present invention aims at only electromagnetic waves which belong to relatively high frequency bands in excess of 50 MHz, such as FM broadcast waves, television waves and others.

The present invention is characterized by measuring the distribution of surface currents induced on the vehicle body by electromagnetic waves belonging to the above particular wave bands to seek a location on the vehicle body which is higher in surface current density and lower in noise and at which a pickup used in the present invention is to be located.

The distribution of surface currents is determined by a simulation using a computer and also by measuring actual intensities of surface currents at various vehicle locations. In accordance with the present invention, the measurement is carried out by the use of a probe which an operate in accordance with the same principle as that of a high-frequency pickup actually located on the vehicle body at the desired location as will be described hereinafter. Such a probe is moved on the vehicle body throughout the entire surface thereof to measure the level of surface currents at various locations of the vehicle body.

Figure 11:
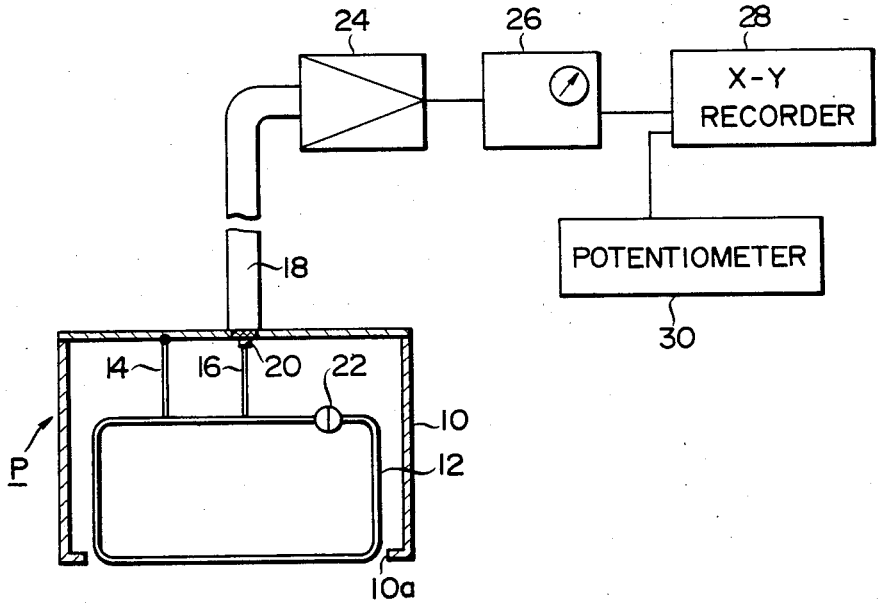
FIG. 11 illustrates a probe for detecting the distribution of surface currents on the vehicle body and having the same construction as that of the high-frequency pickup used in the present invention, and a circuit for processing signals from the probe.

FIG. 11 shows an example of such a probe which is constructed in accordance with substantially the same principle as that of the high-frequency pickup described hereinafter. The probe P comprises a casing of electrically conductive material 10 for preventing any external electromagnetic waves from migrating into the interior thereof and a loop coil 12 rigidly located within the casing 10. The casing 10 includes an opening 10*a* formed therein through which a portion of the loop coil 12 is externally exposed. The exposed portion of the loop coil 12 is positioned in close proximity with the surface of the vehicle body B to detect a magnetic flux induced by surface currents on the vehicle body. Another portion of the loop coil 12 is connected with the casing 10 through a short-circuiting line 14. The loop coil 12 further includes an output end 16 connected with a core 20 in an coaxial cable 18. Still another portion of the loop coil 12 includes a capacitor 22 for causing the frequency in the loop coil 12 to resonate relative to the desired frequency to be measured to increase the efficiency of the pickup.

Thus, when the probe P is moved along the surface of the vehicle body B and also angularly rotated at various locations of measurement, the distribution and direction of surface currents can accurately be determined at each of the vehicle locations. In FIG. 11, the output of the probe P is amplified by a high-frequency voltage amplifier 24 with the resulting output voltages being able to be read at a high-frequency voltmeter 26 and also being recorded by an XY recorder 28 to provide the distribution of surface currents at various vehicle locations. The input of the XY recorder 28 receives signals indicative of various vehicle locations from a potentiometer 30 to recognize the value of surface high-frequency current at the corresponding vehicle location.

Figure 12:
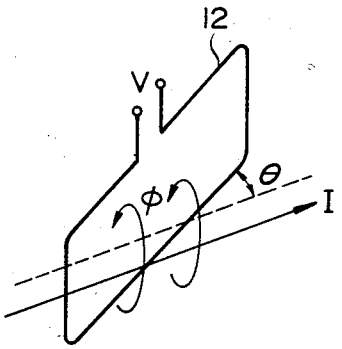
FIG. 12 illustrates the electromagnetic coupling between the surface currents and the pickup loop antenna.
Figure 13:
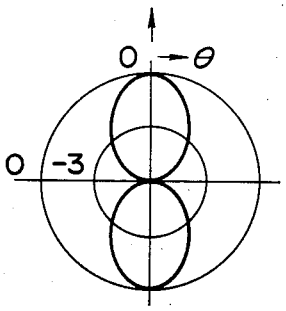
FIG. 13 illustrates the directional pattern of the loop antenna shown in FIG. 12.

FIG. 12 illustrates an angle of deflection $\theta$ between surface high-frequency currents I and the loop coil 12 of said pickup. As shown, a magnetic flux $\phi$ intersects the loop coil 12 to generate a detection voltage V in the loop coil 12. When the angle of deflection $\theta$ is equal to zero, that is, the surface currents I is parallel to the loop coil 12 of the pickup, the maximum voltage can be obtained. In addition, one can know the direction of the surface currents I when the probe P is rotated to obtain the maximum voltage.

Figure 14:
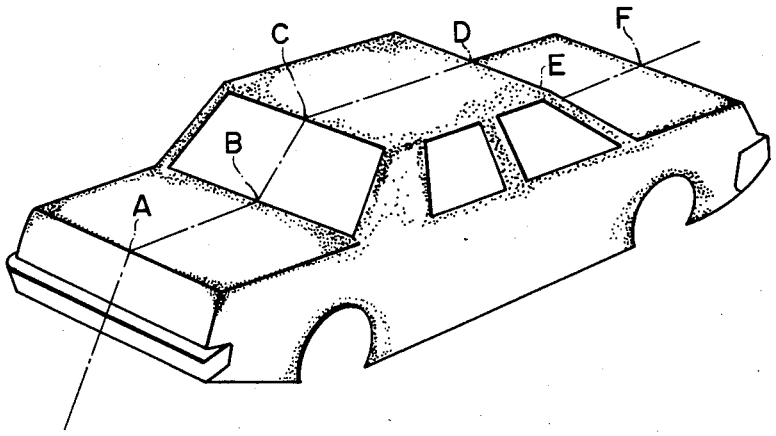
FIG. 14 illustrates the intensity distribution of the surface currents.
Figure 15:
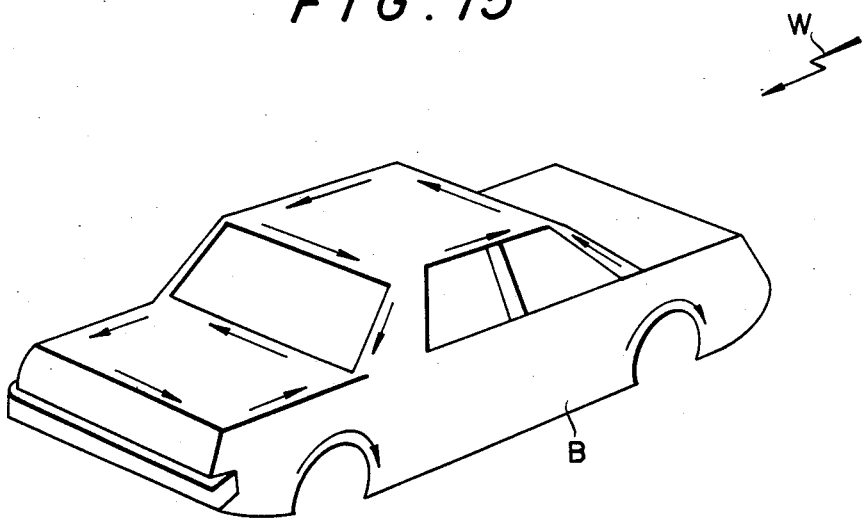
FIG. 15 illustrates the directions of flow of the surface currents.

FIGS. 14 and 15 respectively show the magnitude and direction of surface high-frequency currents induced at various different locations of the vehicle body at the frequency of 80 MHz, the values of which are obtained from the measurements of the probe P and the simulation of the computer. As can be seen from FIG. 14, the distribution of surface currents has higher densities at the marginal edge of the vehicle body and lower densities at the central portions of the flat vehicle panels.

It will also be apparent from FIG. 15 that the surface currents are concentrated in the direction parallel to the marginal edge of the vehicle body or in the direction along the connections of various flat panels.

Figure 17:
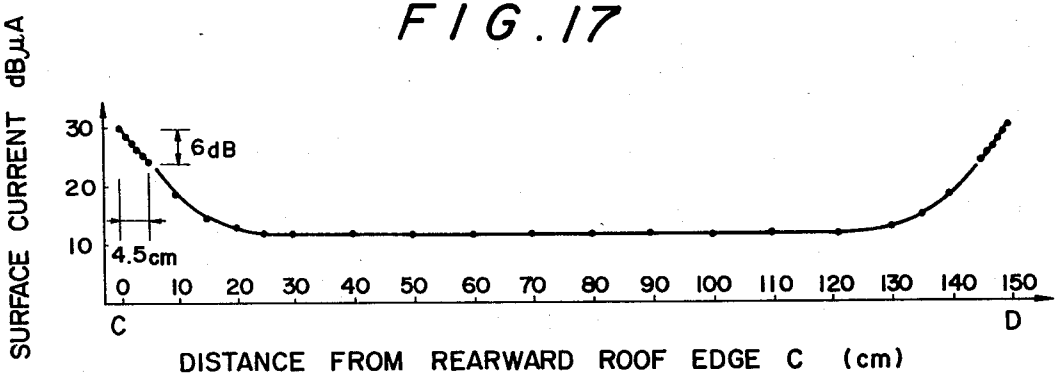
FIGS. 16, 17 and 18 are graphs showing the distribution of surface currents at various locations of the vehicle body shown in FIG. 14 along the longitudinal axis.
Figure 18:
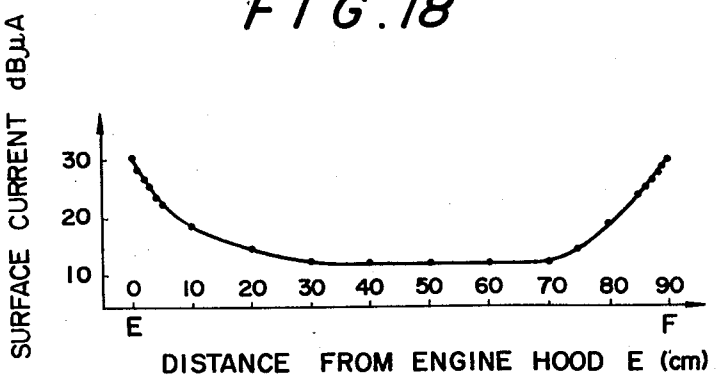
Figure 16:
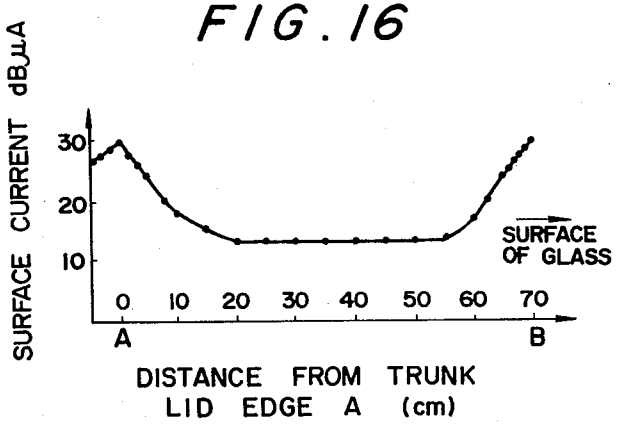

Carefully studying the distribution of surface currents induced at various metallic vehicle portions along the longitudinal axis of the vehicle body as shown in FIG. 14, distribution characteristics can be obtained as shown in FIGS. 16 to 18.

FIG. 16 shows a distribution of surface currents along a trunk lid between two points A and B on said longitudinal axis. As can be seen from this figure, the surface currents become very high levels at these points A and B and decrease toward the central portion of the trunk lid from the opposite points thereof.

Thus, if a high-frequency pickup is disposed near the marginal edge of the trunk lid, the currents concentrating thereto can be detected.

Similarly, FIG. 17 shows the distribution of surface currents along the roof panel of the vehicle body while FIG. 18 shows the distribution of surface currents along the engine hood of the vehicle body. As is apparent from these figures, very high level of surface currents are respectively at the marginal edges of the roof panel and engine hood. The value of the surface currents decreases toward the central portion of each of the vehicle sections.

It is thus understood that the pickup should be disposed at or near the marginal edge of each of the vehicle sections to catch broadcast waves with a good sensitivity.

In accordance with the present invention, the high-frequency pickup can similarly be located on one of pillars and fenders other than the lids and roof panel.

Although the loop antenna of the high-frequency pickup has longitudinally been arranged adjacent to and along the marginal edge of each of the vehicle sections in accordance with the present invention, this loop antenna is preferably positioned within a range determined depending upon the carrier frequency of broadcast waves to be caught to obtain very practicable sensitivity.

The distributions of currents shown in FIGS. 16 to 18 relate to vehicle currents induced by the frequency of FM broadcast wave band which is equal to 80 MHz. The value of surface currents decreases in the direction away from each of the marginal vehicle portions toward to the corresponding central portions. Considering the range of decreased currents below 6 dB in which a good sensitivity can actually be obtained, it is understood that it becomes possible if the pickup is positioned within a distance of 4.5 cm from each marginal vehicle portion.

Thus, a satisfactory antenna system can be provided in accordance with the present invention if a high-frequency pickup is arranged within a distance of 4.5 cm away from a marginal vehicle portion for the carrier frequency of 80 MHz.

It is found from the computer's simulation and experimental measurements that the above practicable distance depends upon the carrier frequency used therein. It is also recognized that the distance is decreased as the value of the carrier frequency is increased.

From the fact that the practicable distance of 4.5 cm from the corresponding marginal vehicle portion is inversely proportional to the value of the carrier frequency, good results can be obtained relative to the respective values of the carrier frequency if the high-frequency pickup is spaced away from the marginal edge of a metallic vehicle panel within a distance represented by the following formula:

$$12\times10^3 c/f(m)$$

where c=the velocity of light and f=the carrier frequency.

In this manner, the present invention provides an improved high-frequency pickup which is located adjacent to the marginal edge of each of the metallic vehicle body and which is preferably disposed within said range from that marginal edge.

For example, where a carrier frequency equal to 100 MHz is to be caught, a high-frequency pickup may be disposed at a vehicle location spaced away from a desired marginal edge of the vehicle body within a distance of 3.6 cm. It will be apparent that as the value of the carrier frequency f is increased, the distance between the high-frequency pickup and the corresponding marginal edge of the vehicle body will be decreased.

FIGS. 1 to 4 illustrate a first embodiment of the high-frequency pickup according to the present invention in which it is disposed near the marginal portion of the rearward area of the vehicle roof panel.

Figure 1:
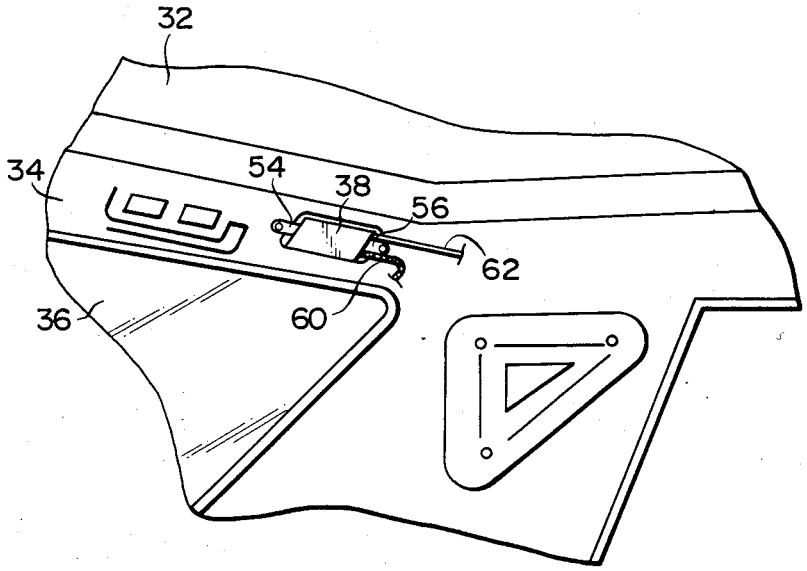
FIG. 1 is a schematically perspective view showing a first preferred embodiment of an automobile antenna system constructed according to the present invention, with an electromagnetic coupling type high-frequency pickup being mounted on the rearwindow frame of the vehicle roof panel.

Referring to FIG. 1, a roof panel of metal 32 is shown to be exposed. This roof panel 32 includes a rearwindow frame 34 with which a rearwindow glass 36 is connected and which is a desired marginal edge of the vehicle body. In the illustrated embodiment, a high-frequency pickup 38 is positioned inwardly spaced away from the rearwindow frame 34 within a distance of 4.5 cm.

Figure 2:
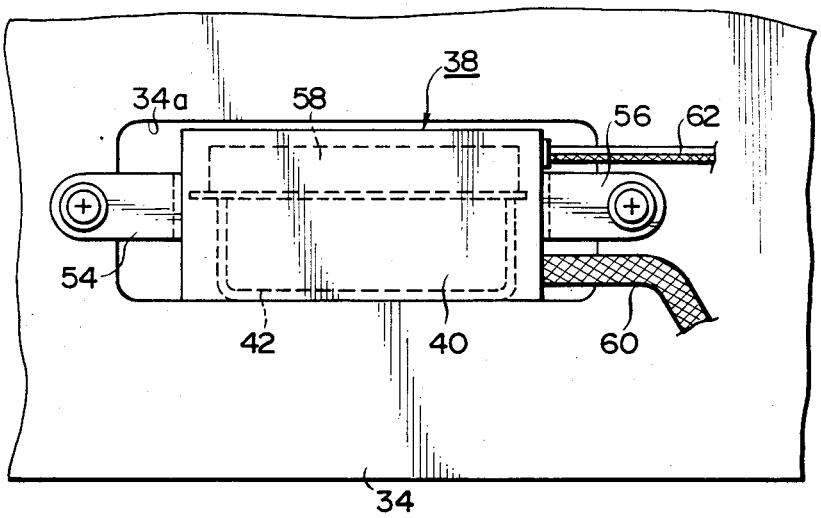
FIG. 2 is a plan view showing the details of the mounting of the high-frequency pickup shown in FIG. 1.

As shown in FIG. 2, the high-frequency pickup 38 includes a metallic casing 40 for externally shielding a magnetic flux and a loop antenna located within the casing 40. Therefore, this pickup is of an electromagnetic coupling type similar to the aforementioned probe including its loop coil for measuring the distribution of surface currents on the vehicle body.

Figure 3:
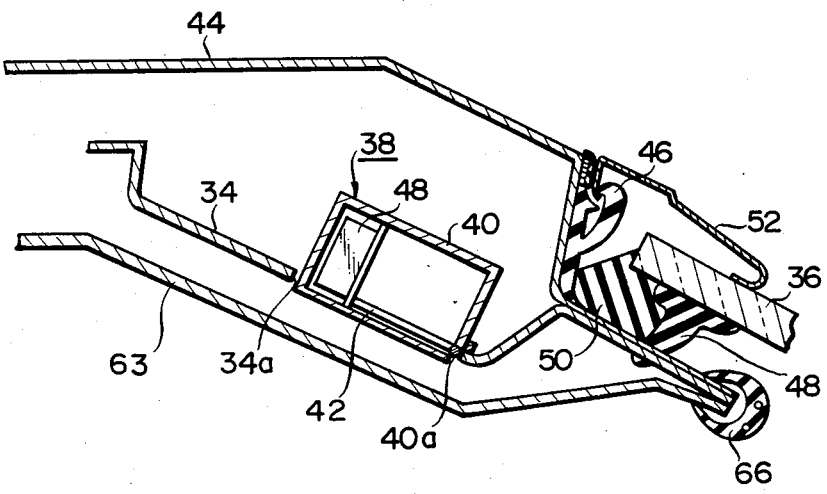
FIG. 3 is a cross-sectional view of the primary parts in the first preferred embodiment.
Figure 4:
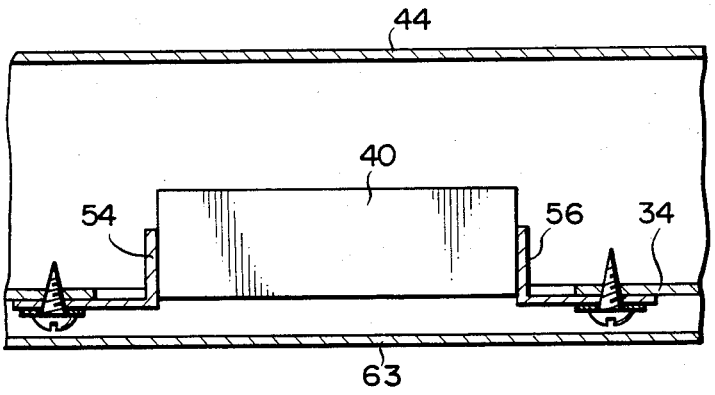
FIG. 4 is a cross-sectional view, from another direction, of the mounting of the high-frequency pickup in the first preferred embodiment.

FIG. 3 shows the high-frequency pickup 38 if it is rigidly mounted on the roof panel 32 which includes a roof panel portion 44. The rearwindow frame 34 is connected with one end of this roof panel portion 44. The rearwindow glass 36 also is rigidly mounted on the roof panel portion 44 through a fastener 46 and dam 48 which are sealingly adhered to each other by a mass of adhesive 50. Furthermore, a molding 52 is rigidly mounted between the roof panel portion 44 and the rearwindow glass 36.

In the illustrated embodiment, the rearwindow frame 34 is provided with an opening **34*a* into which the casing 40 of the high-frequency pickup 38 is inserted. Thus, the loop antenna 42 of the high-frequency pickup 38 can be positioned at a location opposing to the marginal edge portion of the rearwindow frame 34**.

As seen from FIG. 3, the casing 40 is provided with an opening **40*a* through which one longitudinal side of the loop antenna 42 is externally exposed. Thus, the exposed portion of the loop antenna 42 will be located in close proximity with the open edge of the rearwindow frame 34. Therefore, any magnetic flux induced by surface high-frequency currents at the marginal edge portion of the rearwindow frame 34 can positively be caught by the loop antenna 42. Moreover, since any external magnetic flux is positively shielded by the casing 40, the induced currents can more sensitively be detected by the high-frequency pickup 38**.

The casing 40 of the high-frequency pickup 38 can positively be fixed to the rearwindow frame 34 in position by the use of L-shaped brackets 54 and 56 which are respectively coupled with the opposite ends of the casing 40 and also connected with the rearwindow frame 34 by any suitable screw means.

The casing 40 of the high-frequency pickup 38 includes a circuitry 58 contained therein which is connected with the loop antenna 42. The circuitry 58 includes its internal components such as a pre-amplifier and others for processing detected signals. The resulting high-frequency detection signals are externally taken through a coaxial cable 60 and then processed by the same circuit as that used in measuring the distribution of surface currents. The circuitry 58 receives power and control signals through the coaxial cable 62.

The loop antenna 42 is in the form of a single wound coil which is covered with an insulation such that the coil can be arranged in an electrically insulated relationship with and in contact with the rearwindow frame 34. Thus, the magnetic flux induced by the surface currents can intersect the loop antenna 42 with an increased intensity.

After the high-frequency pickup has been incorporated into the exposed portion of the roof panel 32 and particularly the rearwindow frame 32, a roof garnish 63 is rigidly mounted on the roof panel 32 while an edge molding 66 is secured to the ends of the roof garnish and rearwindow frame 63, 34.

In the present embodiment, the exposed side of the loop antenna 42 through the casing 40 is arranged from the marginal edge of the rearwindow frame 34 within a distance of 4.5 cm so that the broadcast waves belonging to FM broadcast frequency band of 80 MHz can positively be detected by catching the surface currents flowing on the marginal edge of the rearwindow frame 34. Since such surface currents flow in the direction along the peripheral portion of the vehicle body as can be seen from FIG. 15, the length of the loop antenna 46 is arranged in the direction along the peripheral portion of the rearwindow frame 34.

In accordance with the first embodiment of the present invention, there is provided a very efficient antenna system for automobiles which has no exposed portion and which can positively receive electromagnetic waves belonging to high frequency bands by electromagnetically detecting the surface currents at the marginal portion of the vehicle body and particularly at the marginal edge of the roof panel by the use of the high-frequency pickup.

Figure 5:
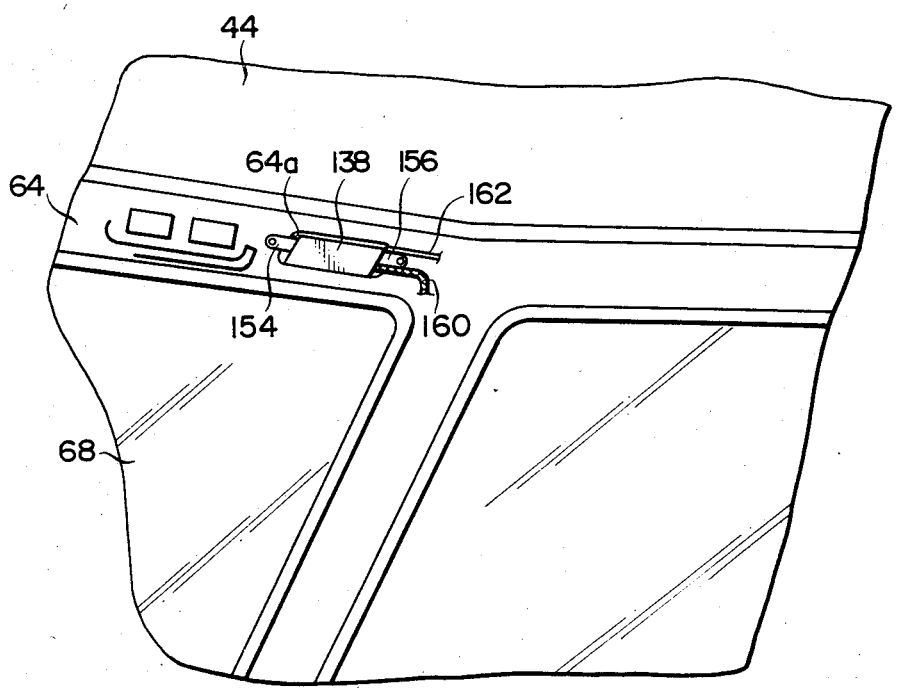
FIG. 5 is a schematically perspective view of a second preferred embodiment of the automobile antenna system constructed according to the present invention, with a high-frequency pickup being mounted on the inner header panel in the vehicle roof.
Figure 6:
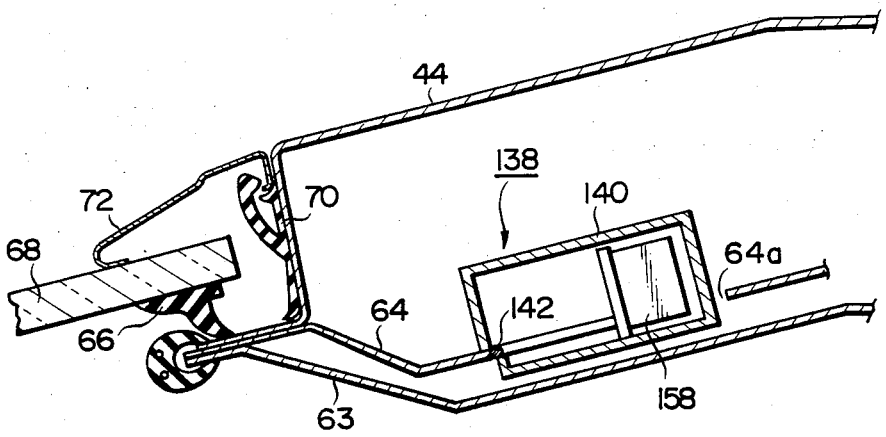
FIG. 6 is a cross-sectional view showing the primary parts in the second preferred embodiment.

FIGS. 5 and 6 show a second preferred embodiment of the present invention in which a high-frequency pickup 138 is disposed in a service hole 64*a* of an inner header panel 64 on the forward end of the roof panel 32.

As can be seen from FIG. 6, a windshield 68 is rigidly mounted on the roof panel portion 44 of the roof panel 32 through a dam 66. As is well-known, a molding 72 is connected between the roof panel portion 44 and the windshield 68 through a stopper 70.

The high-frequency pickup 138 of the second embodiment is similar to that in the first embodiment and therefore similar parts are denoted by similar reference numerals respectively added by one hundred. As will be apparent from FIG. 6, a loop antenna 142 is positioned inwardly away from the marginal edge of the inner header panel 64 within the range of 4.5 cm. Thus, surface currents concentrating on the inner header panel 64 with an increased density can positively be detected by the high-frequency pickup 138.

Figure 7:
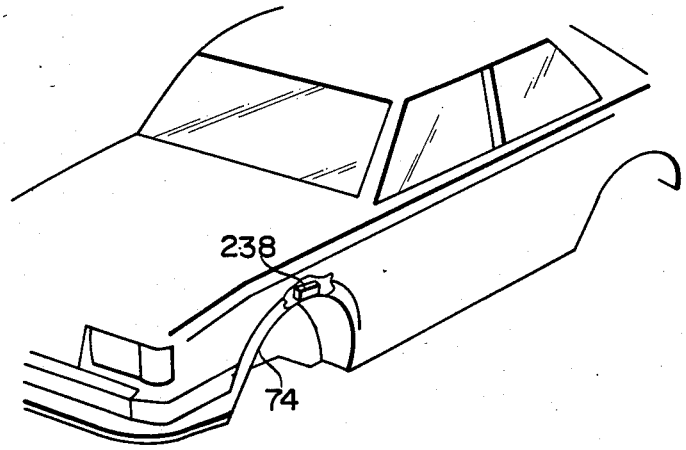
FIG. 7 is a perspective view of a third preferred embodiment of the automobile antenna system constructed according to the present invention, with a high-frequency pickup being mounted on a fender of the vehicle body.
Figure 8:
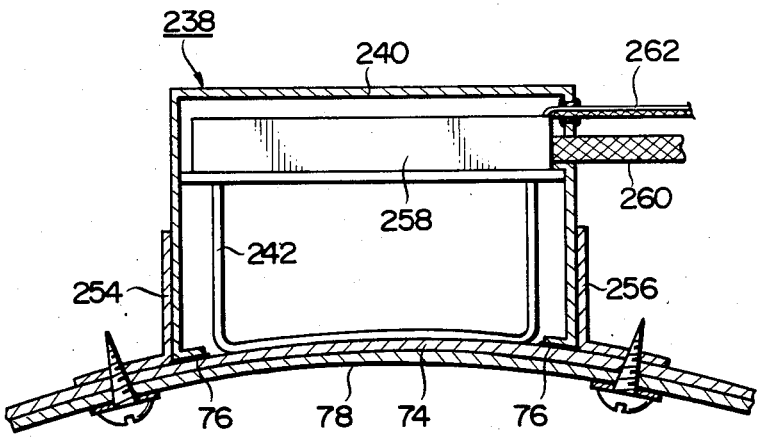
FIGS. 8 and 9 are cross-sectional views showing the mounting of the high-frequency pickup of the third preferred embodiment as viewed from different directions, respectively.
Figure 9:
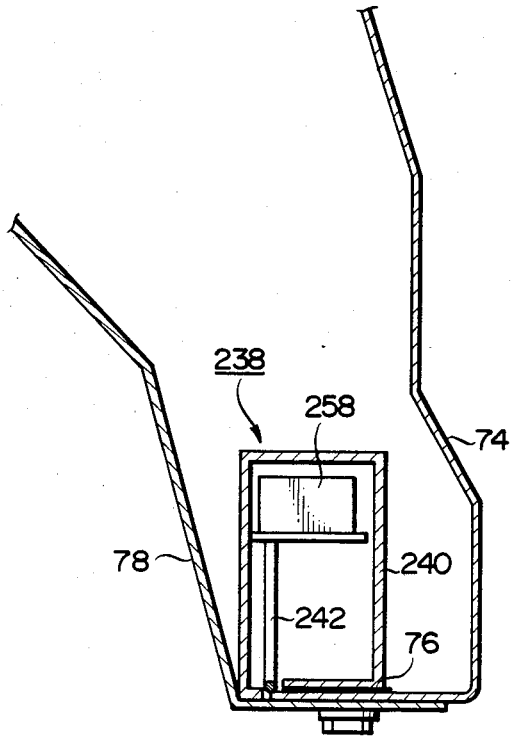

FIGS. 7, 8 and 9 show a third preferred embodiment of the present invention in which an electromagnetic coupling type high-frequency pickup 238 is located on the marginal edge of a fender 74 in an automobile since the concentrating surface currents of high density flow similarly on the fender edge as will be understood from FIGS. 14 and 15.

The high-frequency pickup 238 is positioned inwardly away from the marginal edge portion of the vehicle fender 74 within a predetermined range (of 4.5 cm in the illustrated embodiment) such that FM broadcast waves having its frequency of 80 MHz can more efficiently be detected by the pickup 238. In FIGS. 7, 8 and 9, similar parts are designated by similar reference numerals respectively added by two hundred.

In the third embodiment, the high-frequency pickup 238 includes a loop antenna 242 which is previously adhered to the inside of the fender 74 through adhesive 76 with the length of the loop antenna 242 being opposed to the marginal edge of the fender 74. Thereafter, a fender liner 78 is rigidly fastened to the opposite side of the fender 74 by any suitable means such as screws.

In the third embodiment of the present invention, similarly, the high-frequency pickup is longitudinally positioned on the marginal edge portion of the metal sheet or fender of the vehicle body. By actually setting the distance between the pickup and the marginal edge of the fender 74 within the range of 4.5 cm, surface currents flowing on the vehicle body can positively be detected by the high-frequency pickup.

Although the invention has been described as to the electromagnetic coupling type high-frequency pickup, it can similarly utilize an electrostatic coupling type pickup which comprises a detecting electrode longitudinally disposed along the marginal edge of a vehicle sheet metal through an air gap or insulation. Between the detecting electrode and the surface of the vehicle is formed an electrostatic capacity through which high-frequency surface currents are fetched by the detecting electrode.

Furthermore, the present invention may use a high-frequency pickup of a coil type having a ferrite core which is arranged so that the core will be parallel to and in close proximity with the marginal edge of a rearwindow frame, inner header panel or fender. A coil wound about the ferrite core is used to fetch the induced currents.

It will be apparent from the foregoing that in accordance with the present invention, the antenna system can receive broadcast waves belonging to relatively high frequency bands such as FM frequency bands by detecting the high-frequency surface currents induced particularly at the marginal edge of the vehicle body. Therefore, the antenna system can effect its good detection with higher density and with less noise and be miniaturized without any externally exposed portion.

We claim:

1. An automobile antenna system for detecting surface high-frequency currents which are induced on a vehicle body and concentrated into the marginal edge of the vehicle body, said antenna system comprising a high-frequency pickup longitudinally disposed along and in close proximity with the marginal edge portion of the vehicle body, said high-frequency pickup being spaced away from the marginal edge of the vehicle body within a range represented by the following formula:

$$12\times10^{-3}c/f(m)$$

where c=the velocity of light and f=the carrier frequency of broadcast waves.

2. An automobile antenna system as defined in claim 1, the high-frequency pickup being disposed near the marginal portion of the rearward area of a vehicle roof panel.

3. An automobile antenna system as defined in claim 2, said high-frequency pickup including a metallic casing for externally shielding a magnetic flux and a loop antenna located within the casing.

4. An automobile antenna system as defined in claim 3, the casing of the high-frequency pickup being disposed within an opening provided on a rear window frame, an exposed portion of the loop antenna being located in close proximity with the open edge of the rear window frame.

5. An automobile antenna system as defined in claim 4, the loop antenna being in the form of a single wound coil covered with insulation, the coil being arranged in an electrically insulated relationship with and in contact with the rear window frame.

6. An automobile antenna system as defined in claim 1, the high-frequency pickup being disposed in a service hole of an inner header panel on the forward end of a roof panel.

7. An automobile antenna system as defined in claim 1, the high-frequency pickup is positioned inwardly away from the marginal edge portion of a vehicle fender.

* * * * *